US010188162B2

(12) United States Patent
Block

(10) Patent No.: US 10,188,162 B2
(45) Date of Patent: Jan. 29, 2019

(54) GARDENING UTILITY TOOL

(71) Applicant: Sasha Block, Greenville, SC (US)

(72) Inventor: Sasha Block, Greenville, SC (US)

( * ) Notice: Subject to any disclaimer, the term of this patent is extended or adjusted under 35 U.S.C. 154(b) by 83 days.

(21) Appl. No.: 15/254,703

(22) Filed: Sep. 1, 2016

(65) Prior Publication Data

US 2017/0055605 A1 Mar. 2, 2017

Related U.S. Application Data

(60) Provisional application No. 62/213,327, filed on Sep. 2, 2015.

(51) Int. Cl.
*A41D 19/00* (2006.01)
*A41D 19/015* (2006.01)
*A41D 27/00* (2006.01)

(52) U.S. Cl.
CPC ... *A41D 19/01594* (2013.01); *A41D 19/0086* (2013.01)

(58) Field of Classification Search
CPC ..... A41D 19/01594; A41D 19/0024; A41D 13/087; A41D 19/00; A01B 1/00; A01B 1/06; A01G 20/30; A61B 17/320708
See application file for complete search history.

(56) References Cited

U.S. PATENT DOCUMENTS 183,375 A * 10/1876 Cutliff ..... A41D 19/01547 172/370
474,929 A * 5/1892 Semirdasky ..... A41D 19/00 2/163
622,386 A * 4/1899 Peery ..... A61B 17/320708 2/21
689,840 A * 12/1901 Jensen ..... A63B 31/04 2/160
883,761 A * 4/1908 Taylor ..... A61F 13/105 112/161
1,038,925 A * 9/1912 McCoig ..... A41D 19/01547 172/370
1,055,838 A * 3/1913 Torrance ..... A41D 19/01547 172/370

(Continued)

FOREIGN PATENT DOCUMENTS

CN 202407198 9/2012
GB 323863 1/1930

(Continued)

*Primary Examiner* — Robert H Muromoto, Jr.
(74) *Attorney, Agent, or Firm* — Douglas Kim Law Firm, LLC; Douglas W. Kim; Seann P. Lahey

(57) ABSTRACT

An improved gardening utility tool including a glove; a set of finger extensions attached to the glove wherein the finger extension can move independently in an open arrangement; a first portion included in each finger extension having a first resiliency; a second portion attached to the first portion having a second resiliency having a proof resilience higher relative to the first portion; a plurality of releasable connections disposed on the finger extensions releasably connecting the finger extensions together to form a composite tool in a fixed arrangement of the finger extensions; a forward edge included in each finger extension having a shape taken from the group consisting of: flat, curved, concave, angled, concave angled, point and any combination thereof.

18 Claims, 8 Drawing Sheets

(56) References Cited

U.S. PATENT DOCUMENTS 1,128,556 A * 2/1915 Vincent ..... A41D 19/01547 2/161.8
1,358,824 A * 11/1920 Burden ..... A41D 19/015 2/161.8
2,409,101 A * 10/1946 Brittingham ..... A01B 1/00 132/333
2,717,546 A * 9/1955 Ryden ..... A41D 19/01547 172/370
2,895,139 A * 7/1959 Compton ..... A22C 25/006 2/161.8
2,954,832 A * 10/1960 Pirone ..... A01G 20/30 172/370
3,593,803 A * 7/1971 Ibach ..... A01B 1/00 172/10
4,089,379 A * 5/1978 Crownover ..... A01B 1/00 172/370
4,149,296 A * 4/1979 Stanford ..... A22C 25/025 2/161.8
4,149,601 A * 4/1979 Taylor ..... A41D 19/01594 172/370
4,474,246 A * 10/1984 Arroyo ..... A01B 1/00 172/370
4,867,246 A * 9/1989 Kiger ..... A01B 1/00 172/370
5,014,792 A * 5/1991 Gierloff ..... A01B 1/06 172/250
5,644,796 A * 7/1997 Laughlin ..... A41D 19/01594 2/160
5,887,283 A * 3/1999 Mackay ..... A01B 1/00 172/370
6,058,510 A * 5/2000 Breitenbach ..... A41D 19/01594 172/371
7,363,660 B1 * 4/2008 Gilliland ..... A41D 19/0017 2/159
D616,273 S * 5/2010 Cohen ..... D8/13
8,214,925 B2 7/2012 Yu
8,856,966 B2 * 10/2014 Doty ..... A61H 7/003 119/600
8,955,166 B1 * 2/2015 Madden, Jr. ..... A41D 19/01594 2/160
9,420,836 B1 * 8/2016 Madden, Jr. ..... A41D 19/01594
2012/0317954 A1 * 12/2012 Landicini, Jr. ..... A01D 7/00 56/400.01
2014/0090179 A1 * 4/2014 Stacy ..... A47J 43/28 7/113
2015/0113703 A1 * 4/2015 Crear ..... B26B 27/007 2/160
2015/0289576 A1 * 10/2015 Woody ..... A41D 19/0024 2/16
2016/0007663 A1 * 1/2016 Price ..... A41D 19/0024 2/160
2016/0157647 A1 * 6/2016 Rampersad ..... A47G 21/001 294/25
2016/0192757 A1 * 7/2016 Tapia ..... A45D 24/14 132/125

FOREIGN PATENT DOCUMENTS

JP 3168241 6/2011
JP 2014205940 10/2014

* cited by examiner

GARDENING UTILITY TOOL

BACKGROUND OF THE INVENTION

1) Field of the Invention

The present invention relates to an improved utility tool such as for gardening.

2) Description of Related Art

When preforming tasks such as gardening where working with material both natural and man-made are needed, tools can provide a significant convenience, prevention from injury, and mechanical advantage. It has been recorded that tools have been developed and used by mankind since God created Adam and Eve.

Traditionally, tools are gripped by the hand and used for performing tasks. Tools, such as a hammer, are gripped by the hand. Because the hammer is held by the hand, attempts to improve the grip on the hammer such as U.S. Pat. No. 8,214,925 directed to a method and apparatus for securely holding a tool. This device includes a glove covering a user's palm and fingers. A flap has a piece of adhesive fabric attached and an additional piece of adhesive fabric placed on the glove over the user's thumb pad. On the back of the user's hand, over the user's fingernails are located additional pieces of adhesive fabric. In use, the user grasps the tool normally and uses the flap and the adhesive fabric pieces to secure the adhesive fabric, forming a secure grip.

Other attempts have been made in integrated tools with gloves such as U.S. Pat. No. 4,089,379 directed to a device having combined features of a glove and a garden tool. The device includes a glove element having a bar grip installed therein, with a tool element attached to the bar grip. In one embodiment, a horizontal bar grip is employed in conjunction with a tool element having forks or tines, such as a rake. In a second embodiment, a vertical bar grip is employed in conjunction with a tool element which has the form of a scoop or spade.

Another attempt at a glove tool combination is shown in U.S. Pat. No. 7,363,660 directed to work with a glove to retrieve, manipulate, and hold small metal articles. The work glove may include a palm protector, a thumb cover, an index cover, a middle cover, a ring cover, and a pinky cover. Each cover may allow a portion of the thumb and the digits to be exposed to the local environment. The work glove may include a handling tool having a base, a hood, and a tether attached between the base and the hood.

None of the previous attempts provide for the ability to retain use of the fingers while also permitting tools at the finger tips to be used either independently or collectively. Further, none allow for the use of a shovel or spade type tool when the fingers are placed tougher.

Accordingly, it is an object of the present invention to provide for a tool glove device allowing the user to retain use of the fingers while also permitting tools at the finger tips to be used either independently or collectively.

It is another object of the present invention to allow for tools placed at the distal end of the finger to be used individual or collectively.

SUMMARY OF THE INVENTION

The above objectives are accomplished according to the present invention by providing an improved utility tool comprising: a glove; one or more tool extensions attached to the fingers of the glove; and one or more interlocking members cooperatively associated with the adjacent tool extension to allow the tool extension to be used in a combined arrangement or independently.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits, and advantages of the present invention will be apparent from this summary and certain embodiments described below, and will be readily apparent to those skilled in the art. Such objects, features, benefits, and advantages will be apparent from the above in conjunction with the accompanying examples, data, figures, and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
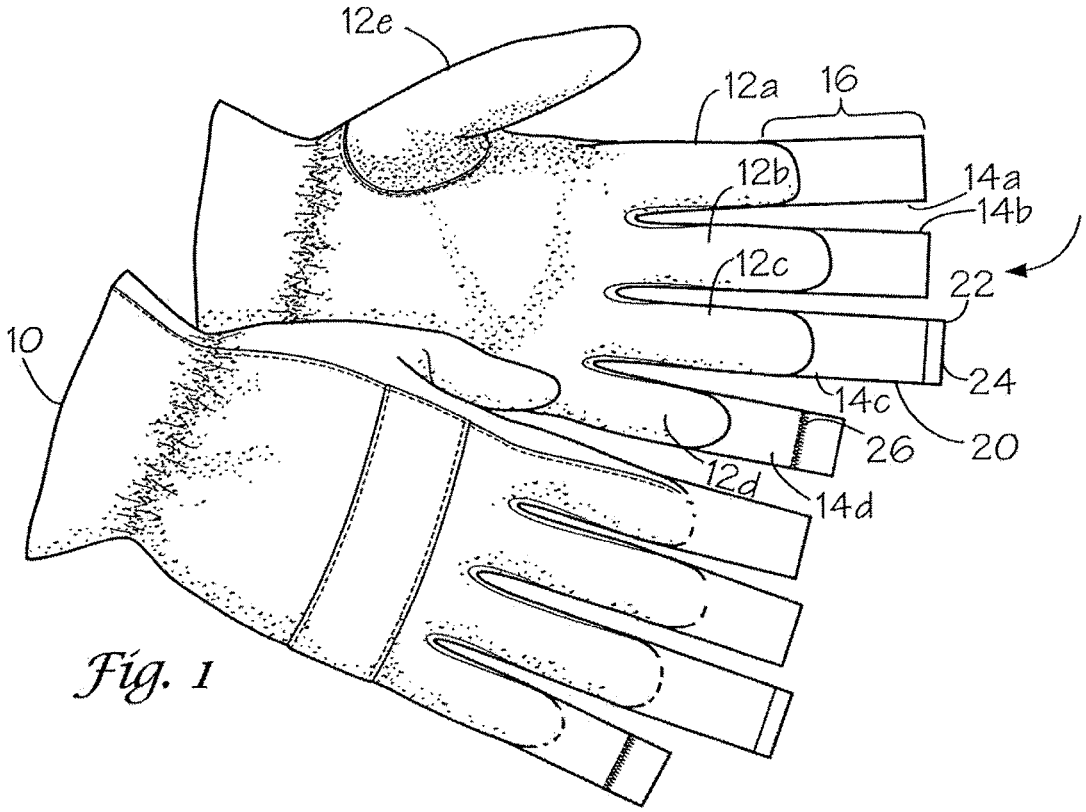
FIG. 1 shows a perspective view of aspects of the invention.

Referring to FIG. 1, a glove 10 includes glove fingers 12*a* through 12*d* and thumb 12*e*. One or more of the glove fingers can include a finger extension 14*a* through 14*d* attached to the respective glove finger or glove thumb. In one embodiment, the finger extensions can be made from material selected from the group consisting of metal, plastic, fiberglass, carbon fiber, polymer, of any combination thereof. The finger extensions can move independently from each other when the glove fingers move and the finger extensions are separated in an open arrangement. The length 16 of the finger extensions can be equal so that the distal end 18 of the finger extension terminate unevenly as shown generally as 18. The finger extensions provide for the user to be able to perform activities including scraping, digging, spinning or securing nuts and bolts, pulling weeds, gardening activities, construction, emergency response activities, safety tasks, manipulation of small or difficult to hold items, spreading, painting, and any combination of these.

The finger extension can include separate portions such as a first portion 20 with light weight or flexible features and a second portion 22 such as for a sharp edge, rigid or stiff portions. For example, the first portion can include a flexible polymer which the second portion can include a metal and even include an edge 24. The second portion can have a second resiliency different from the resiliency of the first portion and can have a higher proof resilience relative to the first portion on one embodiment. In one embodiment, a raised portion 26 can be included on one side of the finger extension and provide for added functionality such as gripping, spreading, scraping and the like.

Figure 2:
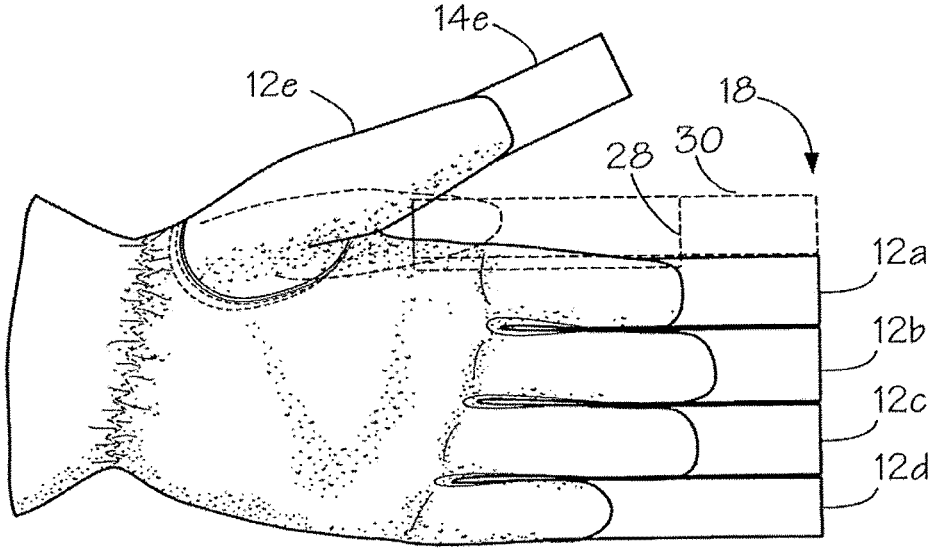
FIG. 2 shows a bottom view of aspect of the invention.

Referring to FIG. 2, in one embodiment, the tool extension of the fingers can be generally in the same plane 18 when the hand is in the flat position. The tool extension 14*e* for the thumb can be aligned beside the finger when the thumb is adjacent to the first finger with the tool extension extending a distance 28 less than that of the tool extension of the first finger. In one embodiment, the tool extension of the thumb can extend to plane 18. The finger extensions can also be magnetized so that when the finger extensions are in close proximity to each other, the extension are attracted to each other forming a plane defined by the connected finger extensions. When attracted to each other, the finger extension can form a composite tool.

Figure 3:
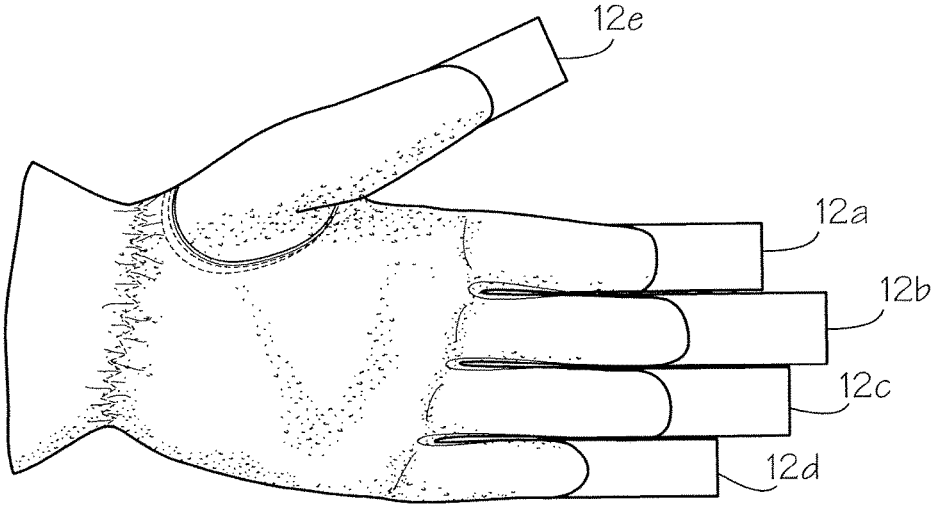
FIG. 3 shows a bottom view of aspect of the invention.
Figure 4:
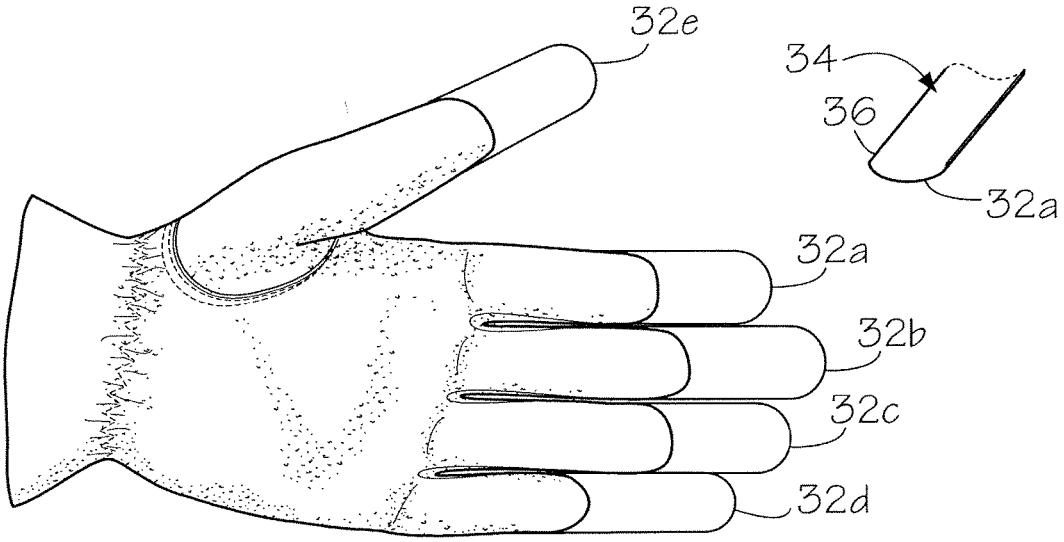
FIG. 4 shows a bottom view of aspect of the invention.

Referring to FIG. 3, in one embodiment, the distal ends are not aligned generally in the same plane when the hand is flat. In one embodiment, the finger extensions can be generally aligned in the same plane when the hand is in a curved or curled position. Referring to FIG. 4, the distal end of the finger extensions can include curved portions 32*a* through 32*e*. The finger extension can also include a concave shape 34 along at least part of the finger extension. The lateral edge 36 can be rounded, flat or edged.

Figure 5:
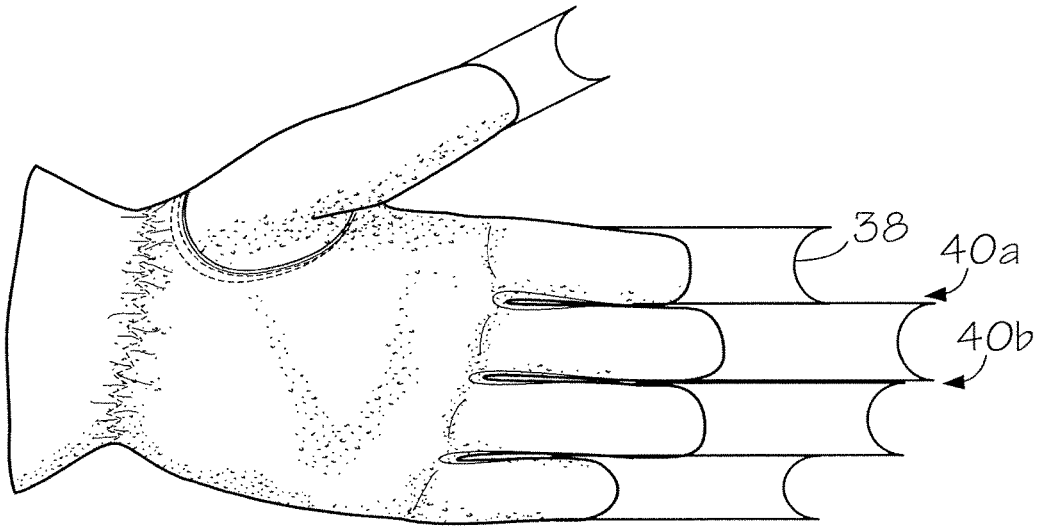
FIG. 5 shows a bottom view of aspect of the invention.
Figure 6:
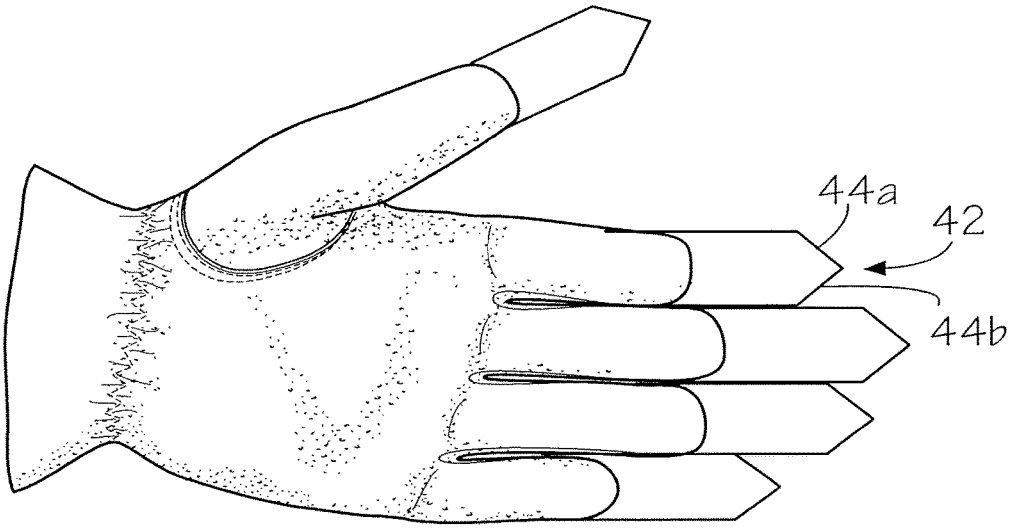
FIG. 6 shows a bottom view of aspect of the invention.
Figure 7:
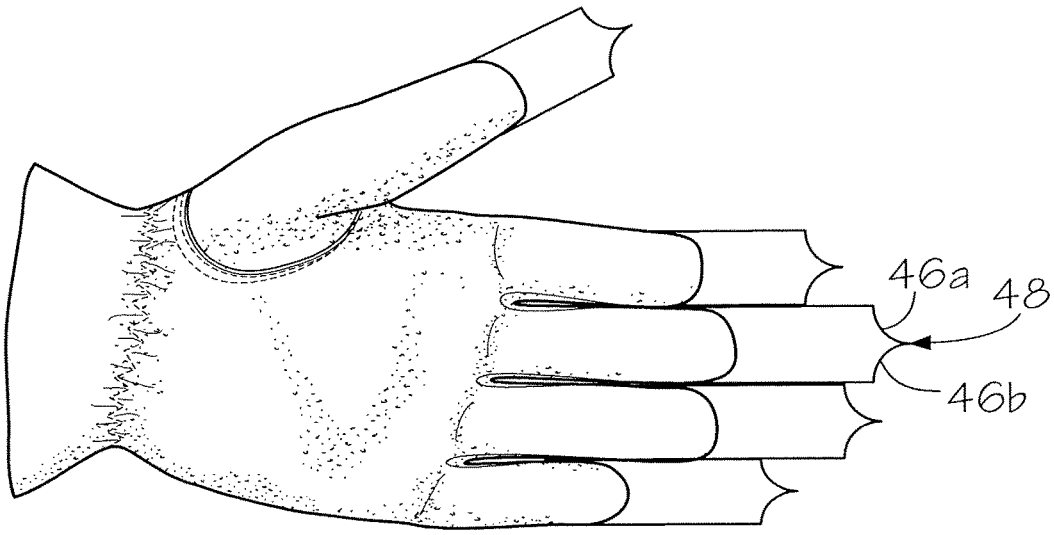
FIG. 7 shows a bottom view of aspect of the invention.
Figure 8:
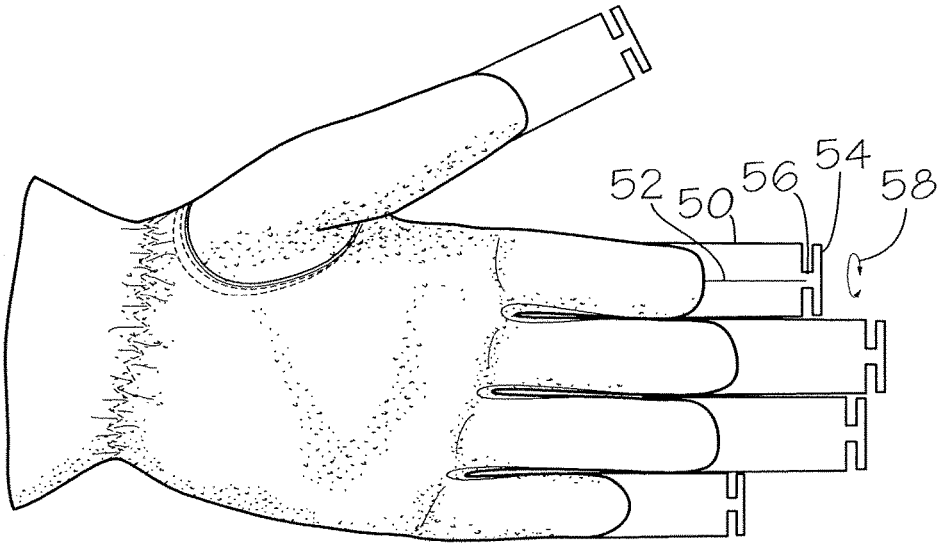
FIG. 8 shows a bottom view of aspect of the invention.

Referring to FIG. 5, the distal end of the finger extension can include a concave distal end 38. Lateral points 40*a* and 40*b* can be defined in the finger extension. Referring to FIG. 6, the distal end of the finger extension can include a point 42 that can be defined by lateral distal angles edges 44*a* and 44*b*. Referring to FIG. 7, the distal end of the finger extensions can include lateral distal concave edges 46*a* and 46*b* defining a point 48. Referring to FIG. 8, the finger extension can include a first portion 50 having a long axis 52 and a second portion 54 attached to the first portion by a pivot 56. The second portion can rotate in a direction shown as 58 thereby providing a non-linear arrangement between the finger extension and its distal end.

The forward edge of the finger extensions can have multiple shapes. For example, the forward edge can be flat, angled, concave angled, pointed or a combination of any of these. Each finger extension does not need to have the same shape as the adjacent finger extension. The thumb extension can also include a first and second portion and a forward edge having one of the above shapes. The first portion can be removably attached to the second portion to allow the forward edge to be changed.

Figure 9:
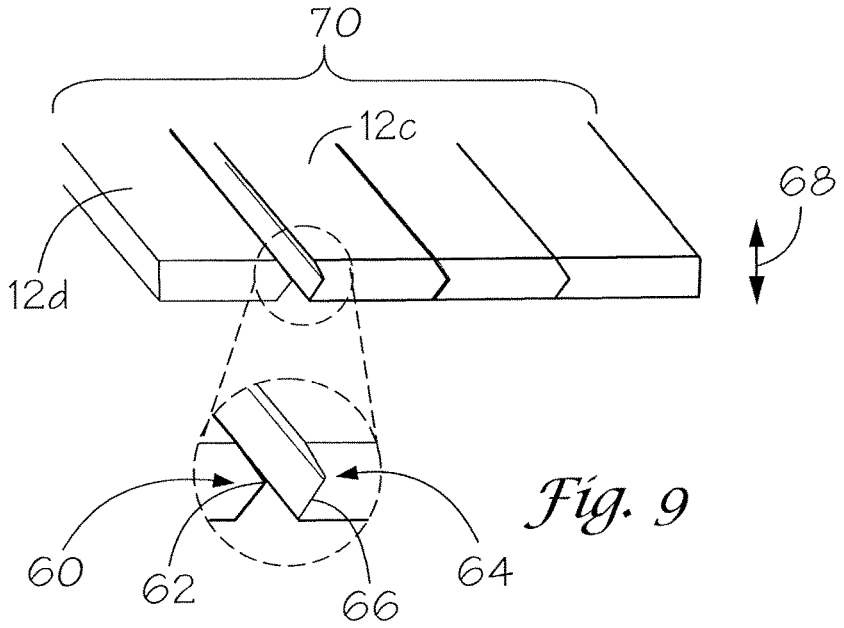
FIG. 9 shows a perspective view of aspects of the invention.

In one embodiment, the finger extensions can interact in a manner that provide stability for a finger that is a combination of several finger extensions operating in concert. Referring to FIG. 9, one finger extension can include an interior side 60 having a ridge 62. The adjacent finger extension can include an opposite interior side 64 that includes a groove 66 for receiving the ridge when the two tool extensions are pressed against each other forming a releasable connection. When pressed against each other, such as by force of the hand or fingers, the adjacent finger extensions resist motion in direction 68 relative to each other to generally position the finger extensions in the same plane. Therefore, the tool extensions can cooperate to define having a functional width of 70 as well as a tool with individual tool extensions.

When the finger extensions are connected, a composite tool is formed. The finger extensions, by being releasably connected, can resist separating when a force is applied to the composite tool from the palm. When digging with the composite tool, the action of digging, scrapping and the like can apply palm side force to the composite tool.

Figure 10:
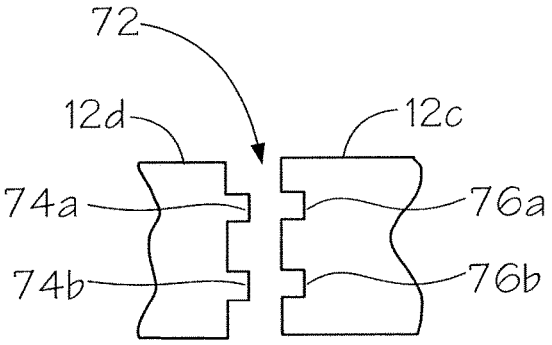
FIG. 10 shows cross section of aspects of the invention.

Referring to FIG. 10, an interlock 72 can be formed by one side of an adjacent finger extension having one of more ridges 74*a* and 74*b*. The ridges can be received into grooves 76*a* and 76*b* respectively to form a releasable connection. In one embodiment, pins can be used in place of the ridges and an opening defined in the finger extension can receive the pins to prevent movement of one finger extension relative to the other. The fit between the adjacent finger extensions can be press fit or a detent loose (wherein the groove of opening is larger than the area of the ridge or pin).

Figure 11A:
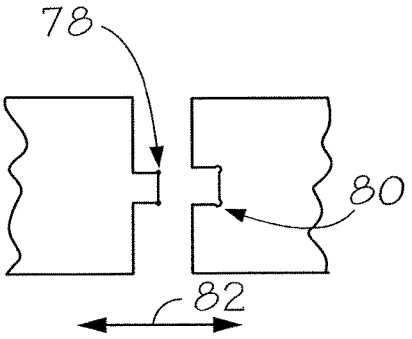
FIGS. 11A through 11C shows a cross section of aspects of the invention.
Figure 11C:
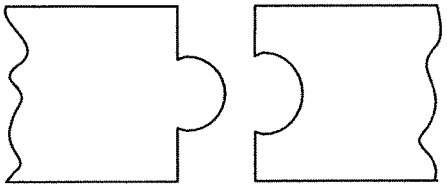
Figure 11B:
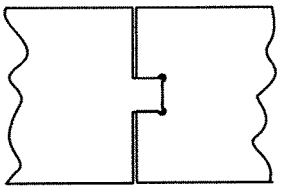

Referring to FIGS. 11A and 11B, the pin or ridge 74 can include a bumped portion 78 that can be disposed on the edge of the ridge or pin. The bumped portion can be received into openings 80 defined in the groove or opening 76 so that the adjacent finger extensions are secured in place adjacent to each other and are separated when sufficient release force is applied in a direction shown generally as 82 to separate the two adjacent tool extensions. The configuration can define a detent. Referring to 110, the ridge can include a rounded shape 81 that can be releasably received into a partially rounded opening 83 and also define a detent.

Figure 12:
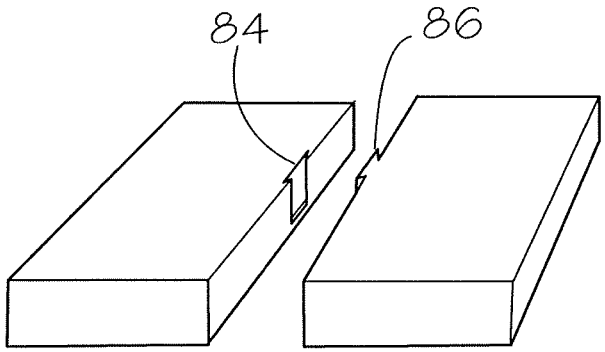
FIG. 12 shows a bottom view of aspect of the invention.
Figure 13:
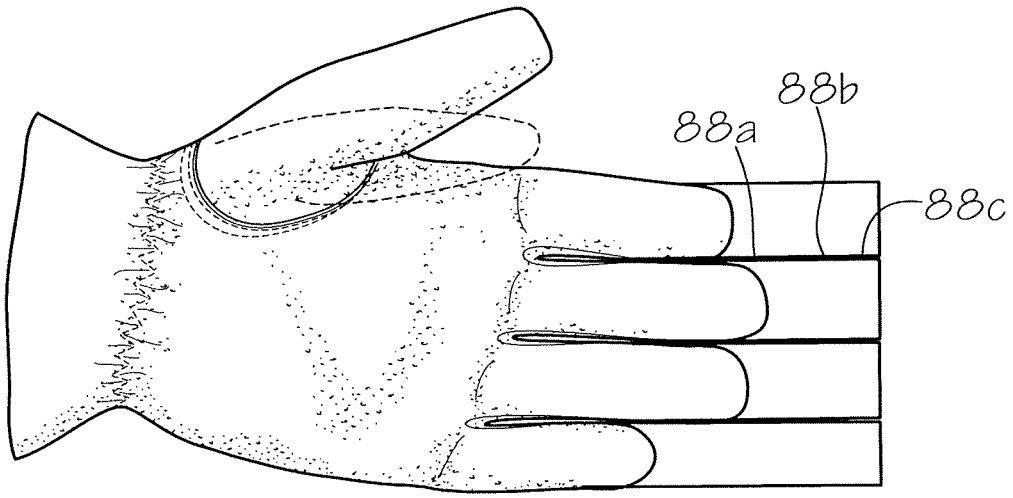
FIG. 13 shows a bottom view of aspects of the invention.

Referring to FIG. 12, one finger extension can include groove of slot 84 that can have generally a dove-tail arrangement and cooperate with ridge or rail 86 to form a releasable connection. The finger extension with the rail can be raised above the finger extension with the slot, pressed against the adjacent finger and slide along the finger extension so that the two adjacent finger extensions are interlocked for providing a larger width tool. Referring to FIG. 13, the placement of the interlocking members can be as one or more locations along the finger extension shown as 88*a* through

88*c* to effect the flexibility of the finger extensions even when in an interlocked position. When the interlocking members are on position near the tip of the glove, more flexibility in the distal ends of the finger extensions is provided.

Figure 14:
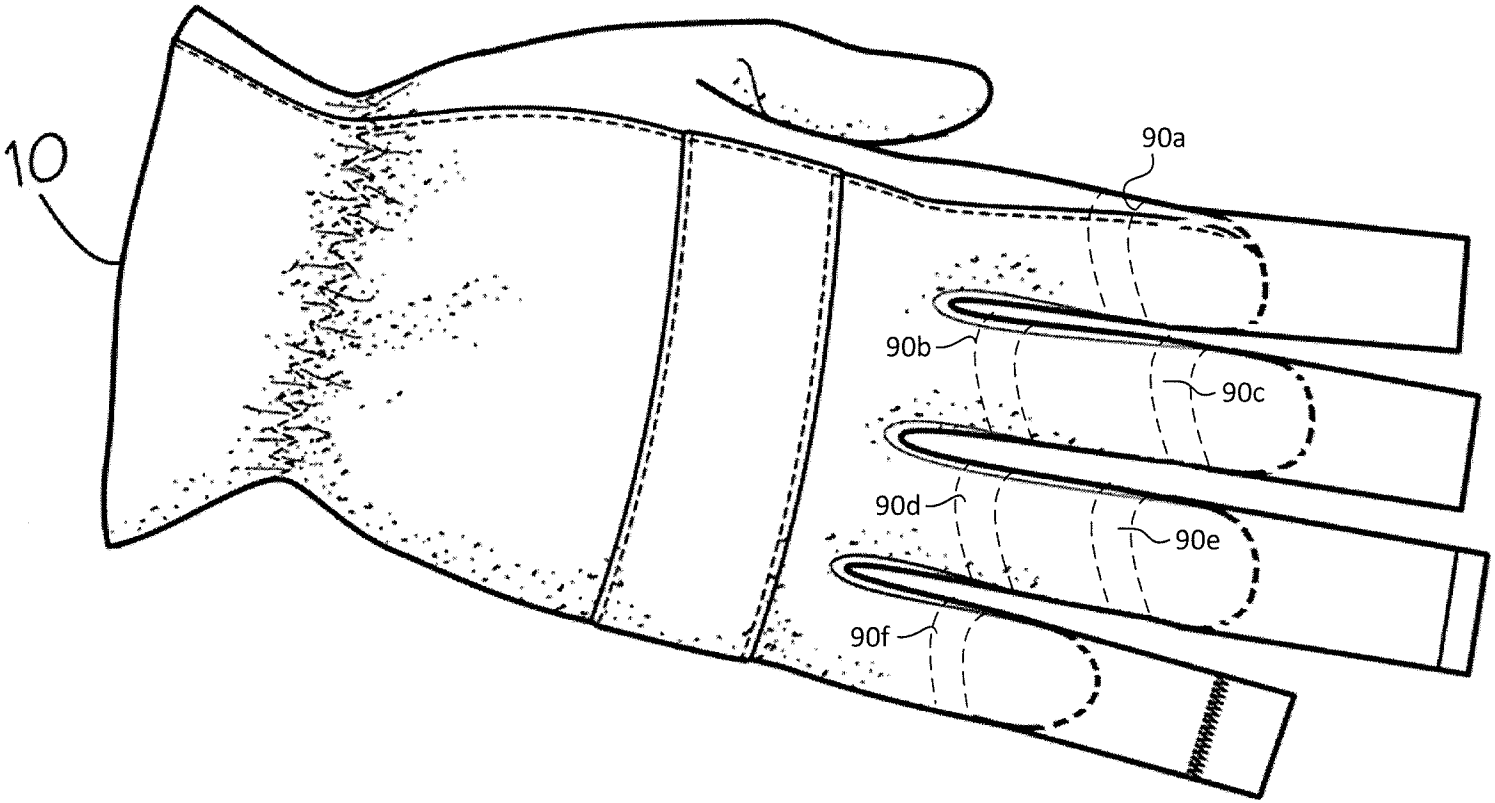
FIG. 14 shows a top view of aspects of the invention.
Figure 15:
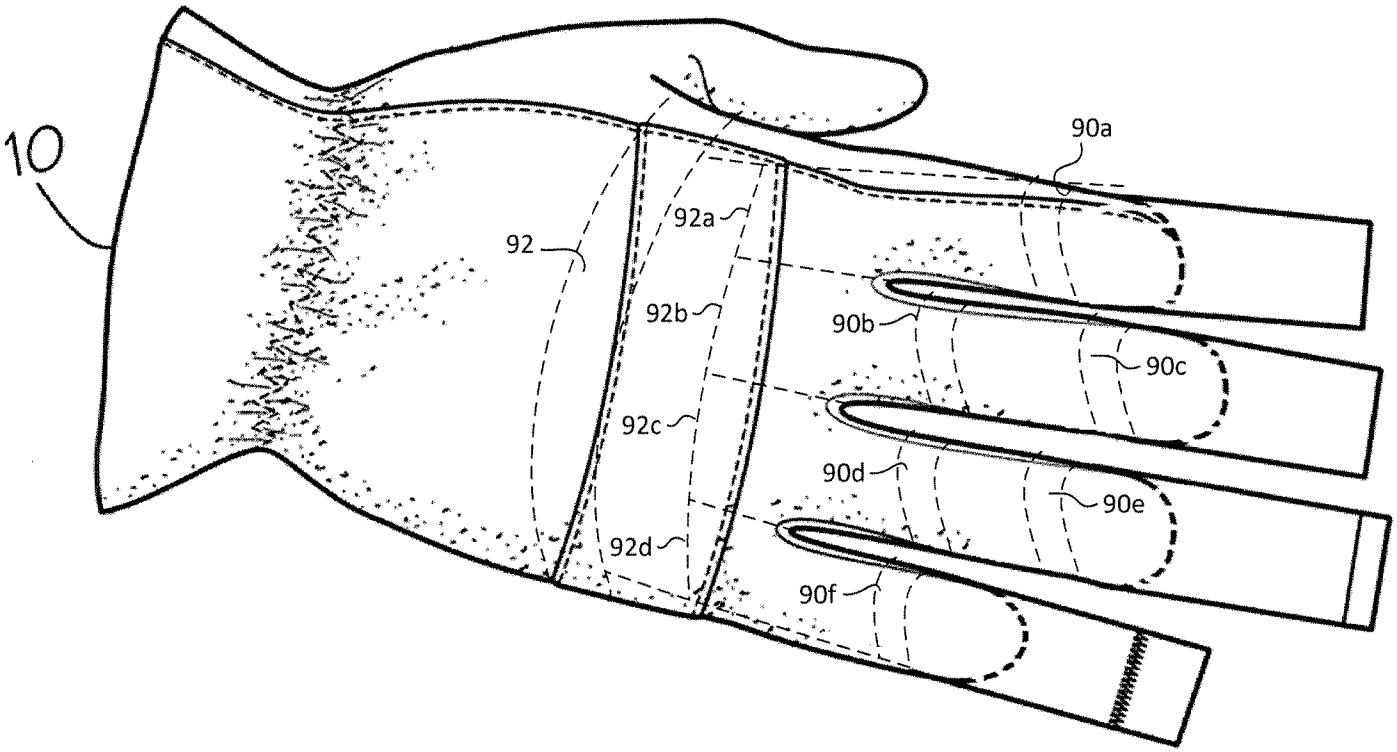
FIG. 15 shows a top view of aspects of the invention.

Referring to FIG. 14, the finger extensions can include finger extension loops 90*a* through 90*f* that are connected to the finger extensions. The finger extension loops can receive the fingers of the wearer and provide support for the finger extension when used. The finger extension loops can be disposed inside the glove or outside the glove. The finger extension loops can partially surround the finger or completely surround the finger. Referring to FIG. 15, a palm support 92 can be attached to the finger extensions to support the finger extensions when in use. The finger extensions can be pivotally attached to the palm support at pivots 94*a* through 94*d* so when the fingers are curved, the finger extension can be moved along with the fingers. When the fingers are extended, the finger extension cannot backbend past a plane define by the back of the glove to prevent the fingers from overextending when in use.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An improved gardening utility tool comprising:

a glove having a set of glove fingers and a glove thumb;

a set of finger extensions attached to a trank of the glove configured to have an open arrangement wherein the finger extensions are configured to move independently of each other;

a first portion included in each finger extension having a first resiliency;

a second portion included in each finger extension attached to the first portion having a second resiliency wherein a proof resilience of the second portion is higher relative to the first portion;

a set of pivots connecting each first portion to a corresponding second portion allowing the second portions to rotated about a long axis of the first portions;

a plurality of releasable connections disposed on adjacent side surfaces of the finger extensions wherein each of said finger extensions releasably interlocks with an adjacent said finger extension along said adjacent side surfaces to form a composite tool in which all of said finger extensions are locked together to move and operate together in a fixed arrangement;

a forward edge included in each finger extension having a shape taken from the group consisting of: flat, curved, concave, angled, concave angled, pointed, and any combination thereof; and, a thumb extension attached to the trank.

2. The tool of claim 1 wherein the first portion is configured to be removably attached to the second portion.

3. The tool of claim 1 including a forward plane defined by the finger extensions.

4. The tool of claim 1 including a forward plane defined by the finger extensions and the thumb extension.

5. The tool of claim 1 including an interior ridge and interior grove included in the releasable connections.

6. The tool of claim 1 including a slot configured to receive a rail included in the releasable connections configured to prevent the finger extensions from separating when palm side force is applied to the composite tool.

7. An improved gardening utility tool comprising:

a set of finger extensions attached to a glove configured to have an open arrangement wherein the finger extension are configured to move independently of each other in the open arrangement;

a finger extension loop attached to each finger extension configured to receive a finger of the user and provide support for the finger extensions when in use;

a palm support attached to the finger extensions configured to receive the hand of the user and provide support for the finger extensions when in use;

a plurality of releasable connections disposed on adjacent side surfaces of the finger extensions wherein each of said finger extensions releasably interlocks with an adjacent said finger extension along said adjacent side surfaces to form a composite tool in which all of said finger extensions are locked together to move and operate together in a fixed arrangement; and, a forward edge included in each finger extension having a shape taken from the group consisting of: flat, curved, concave, angled, concave angled, pointed, and any combination thereof.

8. The tool of claim 7 including a thumb extension attached to the glove.

9. The tool of claim 7 wherein a forward edge is included in each finger extension and includes a shape taken from the group consisting of: flat, curved, concave, angled, concave angled, pointed, and any combination thereof.

10. The tool so claim 7 including:

an interior ridge and an interior grove for receiving the interior ridge included in the releasable connections; and, a detent connection included in the releasable connections.

11. The tool of claim 7 including a slot configured to be received into a rail included in the releasable connections configured to prevent the finger extensions from separating when palm side force is applied to the composite tool.

12. The tools of claim 7 including:

a first portion include in each finger extension; and, a second portion attached to each first portion.

13. The tool of claim 12 including a set of pivots connecting each first portion to a corresponding second portion allowing the second portions to rotate about a long axis of the first portions.

14. The tool of claim 12 wherein:

the first portion has a first resiliency;

the second portion has a second resiliency; and, the second resiliency has a higher proof resilience relative to the first resiliency.

15. An improved gardening utility tool comprising:

a set of finger extensions attached to a glove configured to have an open arrangement wherein the finger extension are configured to move independently of each other and a fixed arrangement wherein the finger extension are configured to form a composite tool; and, a plurality of releasable connections disposed on adjacent side surfaces of said finger extensions wherein each of said finger extensions releasably interlocks with an adjacent said finger extension along said adjacent side surfaces to form said composite tool in which all of said finger extensions are locked together to move and operate together in said fixed arrangement.

16. The tool of claim 15 including a forward edge included in each finger extension having a shape taken from the group consisting of: flat, curved, concave, angled, concave angled, pointed and any combination thereof.

17. The tool of claim 15 wherein the composite tool has a composite forward edge having a shape taken from the group consisting of: flat, curved, concave, angled, concave angled, and pointed.

18. The tool of claim 15 wherein:

the first portion has a first resiliency;

the second portion has a second resiliency; and, the second resiliency has a higher proof resilience relative to the first resiliency.

* * * * *